US011365097B1

(12) United States Patent
Vlasak et al.

(10) Patent No.: US 11,365,097 B1
(45) Date of Patent: Jun. 21, 2022

(54) PLATE CONVEYOR

(71) Applicant: Innova Patent GmbH, Wolfurt (AT)

(72) Inventors: Pavel Vlasak, Sarnthein (IT); Jiri Drencko, Most (CZ)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 17/618,189

(22) PCT Filed: Apr. 27, 2020

(86) PCT No.: PCT/EP2020/061603
§ 371 (c)(1),
(2) Date: Dec. 10, 2021

(87) PCT Pub. No.: WO2020/249296
PCT Pub. Date: Dec. 17, 2020

(30) Foreign Application Priority Data

Jun. 12, 2019 (AT) ..... A 50522/2019

(51) Int. Cl.
*B66B 23/24* (2006.01)
*B66B 21/10* (2006.01)
*B66B 23/20* (2006.01)
*B66B 23/22* (2006.01)

(52) U.S. Cl.
CPC ..... *B66B 23/24* (2013.01); *B66B 21/10* (2013.01); *B66B 23/20* (2013.01); *B66B 23/22* (2013.01)

(58) Field of Classification Search
CPC ..... B66B 23/24; B66B 21/10; B66B 23/20; B66B 23/22
See application file for complete search history.

(56) References Cited

U.S. PATENT DOCUMENTS 2,669,339 A * 2/1954 Hansen ..... B66B 23/04 198/336
3,712,447 A 1/1973 Boltrek et al.
4,059,758 A * 11/1977 Wilwerding ..... G02B 7/305 396/128
4,239,102 A 12/1980 Boltrek
5,366,061 A * 11/1994 Kruse ..... B66B 23/22 198/335
7,543,696 B2 6/2009 Aulanko et al.
8,276,737 B2 * 10/2012 Lanzki ..... B66B 23/028 198/321

(Continued)

FOREIGN PATENT DOCUMENTS

EP 1855980 A1 11/2007
JP S50117188 A 9/1975

(Continued)

*Primary Examiner* — Mark A Deuble
(74) *Attorney, Agent, or Firm* — Laurence A. Greenberg; Werner H. Stemer; Ralph E. Locher

(57) ABSTRACT

A plate conveyor includes a conveyor belt that is formed of interconnected segments which are guided on tracks, and a handrail which is guided on a handrail guide. The conveyor belt has a longitudinal extent, and the handrail runs, at least in sections, in the direction of the longitudinal extent along the conveyor belt. The handrail guide has at least one length compensation element. A length (L) of the compensation element, measured in the direction of the longitudinal extent, is adjustable between a maximumength (Lmax) and a minimum length (Lmin).

8 Claims, 3 Drawing Sheets

(56) References Cited

U.S. PATENT DOCUMENTS

| | | | | |
|---|---|---|---|---|
| 8,913,615 | B2 * | 12/2014 | Pettey | H04L 61/10 370/392 |
| 8,950,568 | B2 * | 2/2015 | Casielles Estrada | B66B 23/147 198/584 |
| 2015/0028228 | A1 * | 1/2015 | Almasy | A61L 2/10 250/492.1 |
| 2020/0087116 | A1 * | 3/2020 | Cai | B66B 23/24 |
| 2022/0081259 | A1 * | 3/2022 | Praxmarer | B66B 23/10 |

FOREIGN PATENT DOCUMENTS

| | | | | |
|---|---|---|---|---|
| WO | WO-2005068341 | A1 * | 7/2005 | B66B 23/24 |
| WO | 2006095045 | A1 | 9/2006 | |
| WO | WO-2020193165 | A1 * | 10/2020 | B65G 17/086 |

* cited by examiner

PLATE CONVEYOR

FIELD AND BACKGROUND OF THE INVENTION

The invention concerns a plate conveyor comprising a conveyor belt consisting of interconnected segments which are guided on tracks, and a handrail which is guided on a handrail guide, wherein the conveyor belt has a longitudinal extent, and wherein at least portions of the handrail guide run along the conveyor belt in the direction of the longitudinal extent, and wherein the handrail guide has at least one length compensation element with at least two bodies, which are arranged substantially successively in the direction of the longitudinal extent, the length of which, measured in the direction of the longitudinal extent, is adjustable between a maximum length and a minimum length.

Plate conveyors serve primarily for transporting persons and may be installed at many various locations, such as for example in airports or railway stations.

Conventional plate conveyors are either permanent installations or "mobile" devices which are installed and used at a location only for a specific period and then removed again. In particular, plate conveyors used for large events, such as exhibitions or fairs, must be able to be erected and dismantled quickly and in some cases adapted to local conditions which may be difficult to assess in advance.

With known "mobile" plate conveyors, normally tracks are laid on site which are composed of various track elements, and on which the conveyor belt of the plate conveyor is guided. For reasons of safety and comfort, a handrail may be provided along at least a portion of the tracks, guided on a handrail guide composed of guide elements. The handrail, which is substantially an endless closed belt, usually consists of a nonslip material, e.g. a plastic. It moves at the same or at least approximately the same speed and in the same direction as the conveyor belt, so that persons standing on the conveyor belt can hold this or be supported thereon.

The disadvantage with known conveyor devices is that the length of the handrail guide can only be changed on site discontinuously, i.e. in steps which correspond to the length of the available guide elements, and not continuously.

For the case that locally, during assembly of the conveyor device, it is found that the length of the handrail guide must be shorter or longer than planned, the handrail guide can only be shortened by the length of at least one of the guide elements used, or lengthened by the length of at least one guide element still available. Since conventional handrail guides are usually composed of relatively long guide elements, the length of conventional handrails can therefore only be varied or adapted very roughly and to an often unsatisfactory extent when this is necessary because of local circumstances.

Furthermore, it may occur that because of environmental influences such as temperature fluctuations, changes in relative humidity, sunlight etc., the length of the handrail changes. In order however to guarantee a substantially constant tension of the handrail, the handrail is usually guided around at least one displaceable pulley so that movement of this pulley in one direction increases the tension of the handrail, and movement of this pulley in the opposite direction reduces the tension of the handrail. Therefore, between the handrail guide adjoining the pulley and the circumferential portion of the pulley over which the handrail is guided, a gap forms which is of varying size depending on the position of the pulley.

SUMMARY OF THE INVENTION

The invention is therefore based on the object of providing a plate conveyor of the type cited initially in which the length of the handrail guide and hence the length of the handrail can be varied as easily as possible and adapted as precisely as possible to a required length. Even small length changes of the handrail guide can thus be implemented quickly on site.

This object is achieved according to the invention with a conveyor device having the features as claimed.

Preferred and advantageous embodiments of the invention are the subject of the subclaims.

According to the invention, it is provided that both bodies have, at each respective, end plate-like protrusions running in the direction of the longitudinal extent and slot-like recesses in between, and that at least portions of the protrusions of the one body are received in the recesses of the other body and vice versa, so that the bodies are displaceable relative to one another in the direction of the longitudinal extent.

The length compensation element allows the length of the handrail guide to be adapted on site, or during assembly of the conveyor device, very precisely to the length of the tracks and hence to the length of the conveyor belt. Adaptation of the length of the handrail is not therefore—as in conventional handrails—only possible very imprecisely in relatively large steps depending on the length of the smallest guide element, but extremely precisely.

In a handrail which is guided over a movable pulley, the handrail guide preferably comprises two length compensation elements according to the invention, which are arranged on both sides directly adjacent to the pulley. In this way, the respective length of the handrail guides adjoining the pulley can be adapted dynamically to the movement of the pulley, so that no gaps can occur between the handrail guide and the pulley.

In the context of the invention, the length of the length compensation element is preferably adjustable without tensioning or stretching, i.e. in the context of the invention, adjustment of the length does not take place via the elasticity of an element or body of the length compensation element which is made of an elastic material such as e.g. rubber. Thus the occurrence of fatigue phenomena, such as for example material creep, on the length compensation element provoked by permanent stresses, is prevented.

In the context of the invention, the length compensation element consists of at least two, possibly more than two components, which are functionally associated with one another but not fixedly connected together. Viewed transversely to the longitudinal extent, in fitted state, in the length compensation element there is no portion without a component of the length element, or without an overlap of at least two of the components.

Particularly preferably, the length of the length compensation element is steplessly adjustable. By the use of one or if necessary several length compensation element(s), thus a handrail guide can be provided in any arbitrary length, i.e. adapted with millimetric precision.

It is particularly preferred if the maximum length of the length compensation element is at least 120%, preferably at least 140%, in particular at least 160% of the minimum length of the length compensation element. Thus in the context of the invention, an adjustment of the length of the length compensation element means a length adjustment which goes beyond varying the size of a structurally imposed play between two or more than two elements of the plate conveyor.

Preferably, the length compensation element has at least two bodies which are arranged substantially successively in the direction of the longitudinal extent, and of which at least one is received and guided at least in portions in the other body or in at least one of the other bodies. The bodies are displaceable relative to one another in the direction of the longitudinal extent.

One of the bodies is received in the other body such that in the overlap region of the bodies, the only gaps, grooves or recesses which are formed or become formed by the length adjustment compensation element are those which do not exceed a specific minimum width or minimum size in the direction of the longitudinal extent or transversely to the longitudinal extent. If this minimum width or minimum size is for example maximum 5 mm, in particular maximum 4 mm, preferably maximum 3 mm, this reduces the risk of injury since in this case, a passenger using the plate conveyor cannot catch a finger in the gap, groove or recess.

Further details, features and advantages of the invention arise from the following description given with reference to the appended drawings which show preferred embodiments. The drawings show:

DETAILED DESCRIPTION OF THE INVENTION

Figure 1:
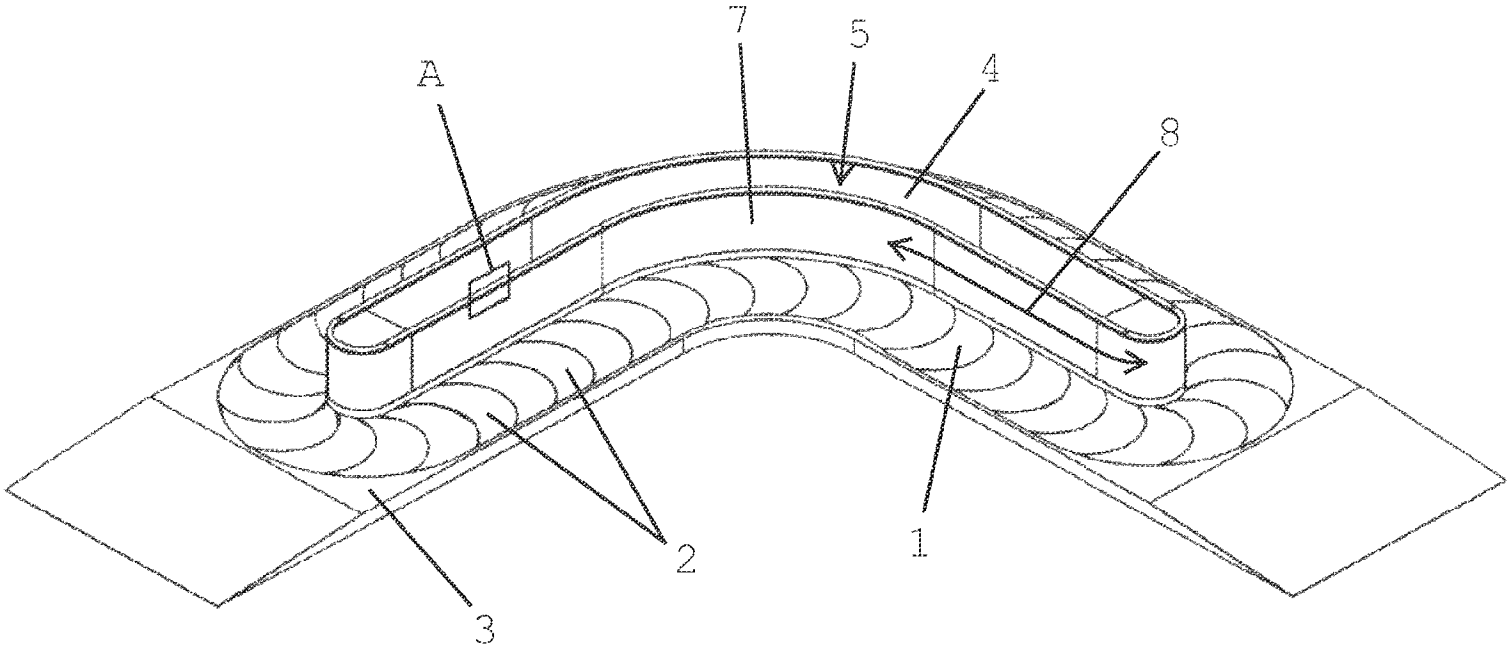
FIG. 1 an isometric view of a plate conveyor according to the invention.

FIG. 1 shows the exemplary structure of a plate conveyor according to the invention which has a continuous closed conveyor belt 1 made of mutually adjoining and interconnected plate-like segments 2.

The segments 2 are guided on tracks (not shown) which are formed from several interconnected track elements.

The side edges of the segments 2 or conveyor belt 1 are covered by a base 3 and/or platforms.

A handrail 4, guided in a handrail guide 5, runs along at least one side of the conveyor belt 1. The handrail guide 5 consists of guide elements 6 which, in the example shown, are arranged on the top of plate-like border elements 7, preferably made of glass or metal, in particular hard glass or steel, so that the handrail 4 is vertically spaced from the conveyor belt 1.

The conveyor belt 1 has a longitudinal extent 8 along which the handrail 4 runs.

In the context of the invention, instead of plate-like border elements 6, the handrail guide 5 may also be arranged on grid-like border elements, on a frame structure or simply on stands or supports.

The handrail 4 may run on one side or both sides of the conveyor belt 1 and extend along the entire length of the conveyor belt 1 or merely along one or more portion(s) of the conveyor belt 1.

Figure 2:
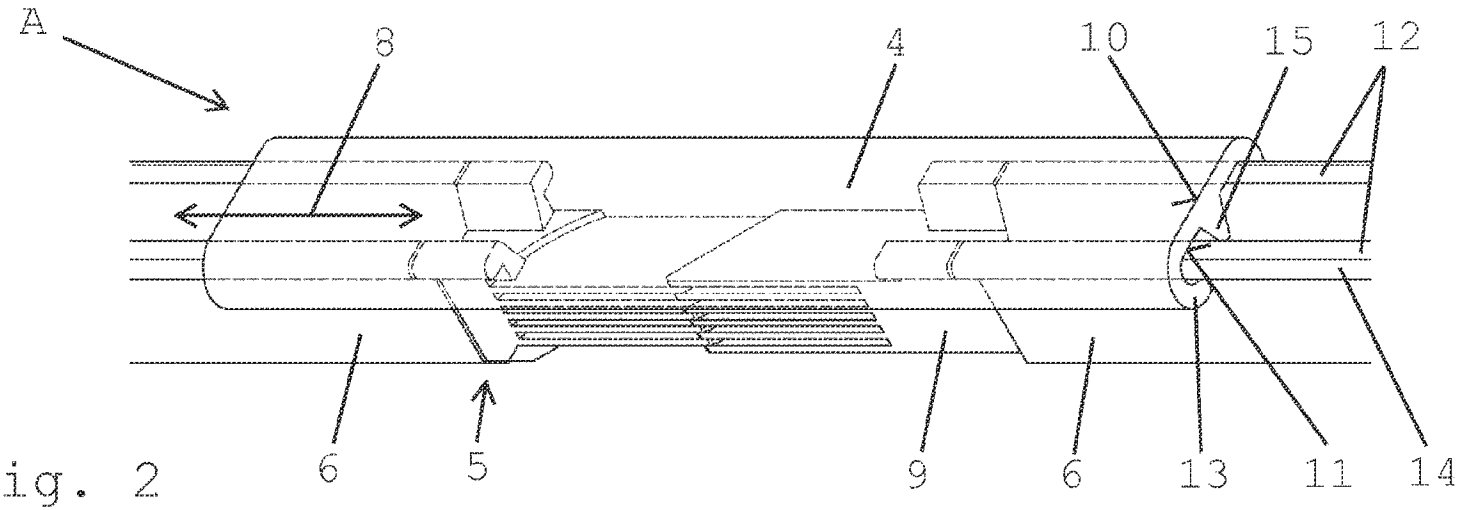
FIG. 2 an isometric detail view of extract A marked in FIG. 1, with a length compensation element arranged in a handrail guide of a plate conveyor according to the invention, FIG. 3 an enlarged isometric view of the length compensation element, not installed in the handrail guide, and FIGS. 4 to 6 isometric views of the length compensation element installed in the handrail guide with differently set lengths.

FIG. 2 shows extract A from FIG. 1 with a portion of the handrail 4 guided on the handrail guide 5, and situated for example in the region of a connecting point of adjoining rail elements.

This portion of the handrail guide 5 has a length-adjustable length compensation element 9 which is arranged flush between two guide elements 6 in the direction of the longitudinal extent 8.

For reasons of clarity, FIG. 2 shows transparently only portions of a handrail 4, while the plate-like border element(s) 7 is/are not shown at all in FIG. 2.

The handrail 4 has substantially the form of a flat belt with an upwardly directed top side 10 and a downwardly directed bottom side 11. The bottom side 11 lies on two lateral, upward pointing guide ribs 12 of the guide elements 6 or the handrail guide 5.

The lateral edges 13 of the handrail 4 are curved downward and surround the downwardly directed edges 14 of the guide ribs 12, so that the handrail 4 is secured against lifting or detaching and against lateral displacement.

A V-belt 15, via which the handrail 4 is driven, is arranged on the underside 11 of the handrail 4, for example vulcanized onto the handrail 4 or formed monolithically on the handrail 4. The V-belt 15 may lie on rollers (not shown) between the guide ribs 12.

In the context of the invention, the handrail 4 may also be shaped differently, and for example have no V-belt 15 or also a plurality of V-belts 15 which are guided between a plurality of guide ribs 12. Accordingly, the handrail guide 4 may have only one guide rib 12 or a plurality of guide ribs 12. Instead of a V-belt 15 or a plurality of V-belts 15, also another type of belt may be used.

Figure 3:
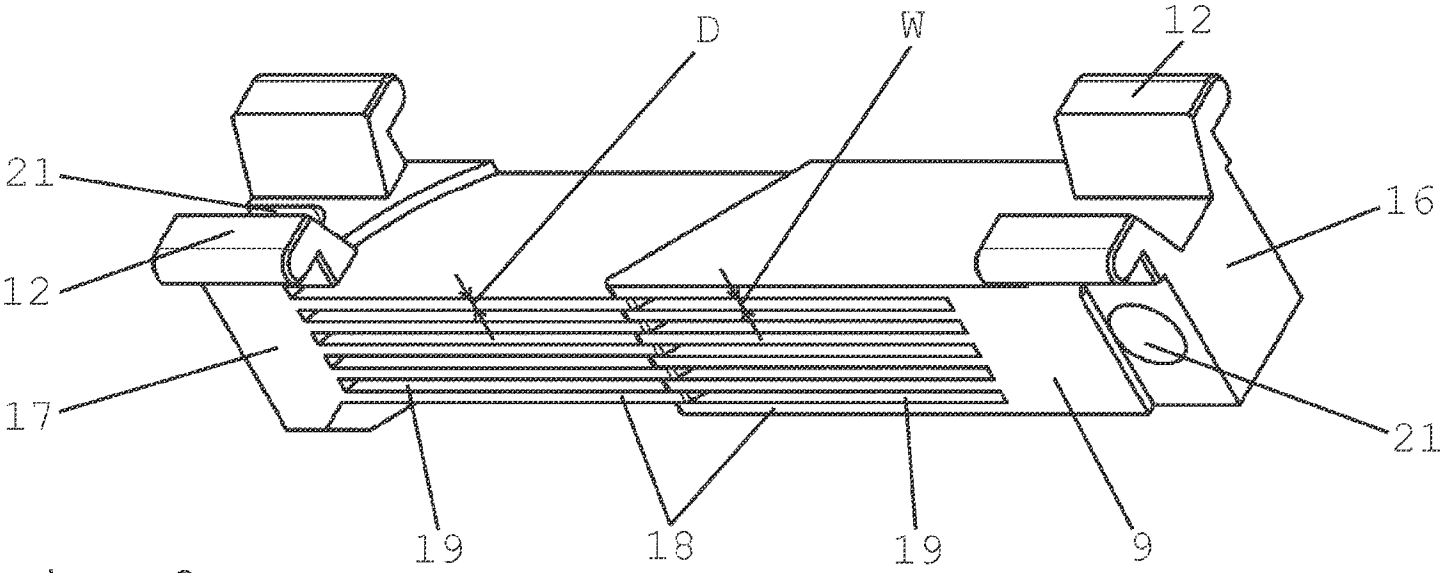

FIG. 3 shows a length compensation element 9 not installed in the handrail guide 5, i.e. separately.

The length compensation element 9 consists of a first body 16 and a second body 17, each of which at one end has plate-like protrusions 18 with slot-like recesses 19 formed in between. The protrusions 18 of the first body 16 engage in the recesses 19 of the second body 17, and vice versa.

Because the bodies 16, 17 are movable away from and towards one another along the longitudinal extent 8 while at least portions of the protrusions 18 are received in the recesses 19, the length L of the length compensation element 9 can be increased or reduced.

Preferably, the thickness D of the protrusions 18 substantially corresponds to the mutual spacing of the protrusions 18 and hence to the width W of the recesses 19.

In the embodiment shown, the protrusions 18 have a uniform thickness D and the recesses 19 have a uniform width W adapted thereto. In the context of the invention however, other embodiments are possible in which the protrusions 18 are provided with different thicknesses D and the corresponding recesses 19 have different widths W.

At a further end at which there are no protrusions 18 or recesses 19, the bodies 16, 17 have connection means 21, such as for example passage holes or grooves. Via these connecting means 21, the length compensation element 9 can be connected to the guide elements 6 of the handrail guide 5 arranged in front and behind in the direction of the longitudinal extent 8, for example via screw connections.

The bodies 16, 17 have guide ribs 12, which are formed as the guide ribs 12 of the adjacent guide elements 6 and adjoin these when the length compensation element 9 is installed in the handrail guide 5. The guide ribs 12 of the bodies 16, 17 each run over a specific distance away from the end with the connection means 21, but not over the entire length of the bodies 16, 17.

The plate-like protrusions 18 and the slot-like recesses 19 of the first body 16 are arranged or formed offset to the plate-like protrusions 18 and slot-like recesses 19 of the second body 17, such that the guide ribs 12 of the first body 16 and the guide ribs 12 of the second body 17 align.

Figure 4:
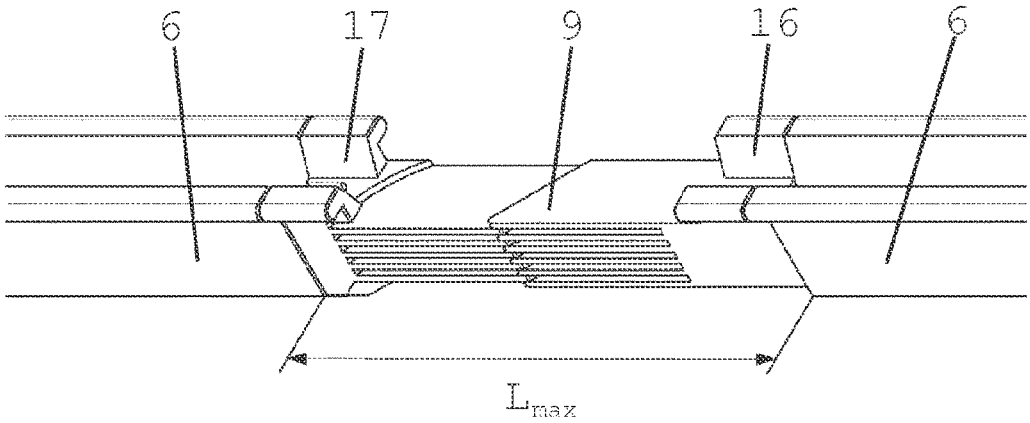
Figure 5:
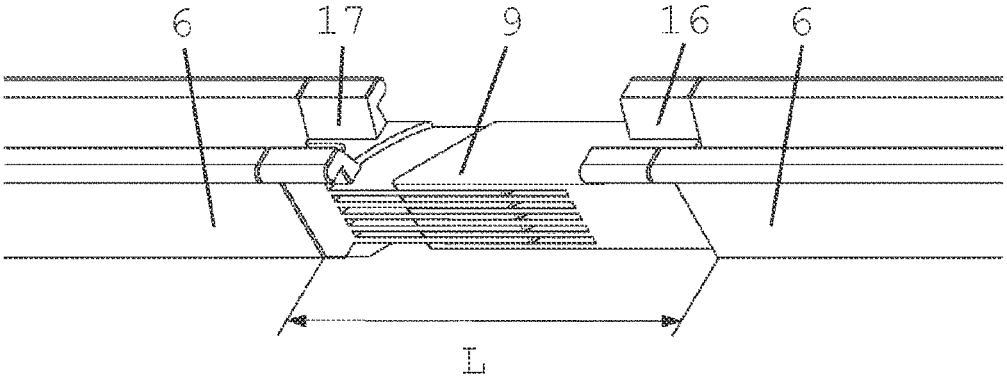
Figure 6:
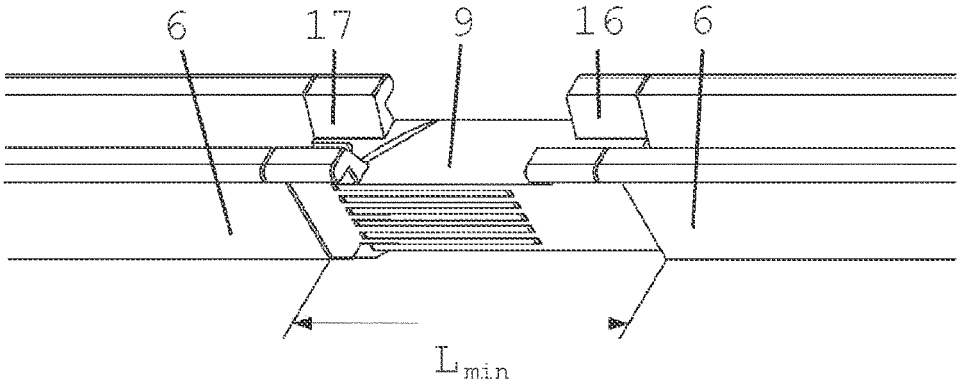

FIGS. 4, 5 and 6 show the length compensation element 9 installed in the handrail guide 5 between two guide elements 6 with differently set lengths L.

In FIG. 4, the ends of the bodies 16, 17 at which the length compensation element 9 is arranged on the adjacent guide elements 6, are moved as far as possible apart so that the length compensation element 9 has a maximum length Lmax. In the context of the invention, at least portions of the protrusions 18 are always received in the slot-like recesses 19, so that no continuous gap running transversely to the longitudinal extent 8 is formed between the bodies 16, 17.

In FIG. 6, the length compensation element 9 has a minimum length $L_{min}$ at which the protrusions 18 are received substantially completely in the slot-like recesses 19, and their tips abut the ends of the slot-like recesses 19.

In FIG. 5, the length compensation element 9 is shown with a length L set between the maximum length L. and the minimum length $L_{min}$.

In an embodiment not shown and not in accordance with the invention, the first body 16 of the length compensation element 9 has a single protrusion 18, for example cuboid, and the second body 17 has the form of the sleeve at its end facing the first body 16.

Portions of the protrusion 18 of the first body 16 are received in the recess 19 of corresponding cross-section formed by the sleeve, and depending on the length L set for the length compensation element 9, are pressed more deeply into the recess 19 or extracted further from the recess 19.

In a further embodiment not shown and not in accordance with the invention, both bodies 16, 17 have the form of a sleeve at their respective end facing the other body 16, 17. A further body with appropriate cross-sectional form is received in the resulting recesses 19. The recesses 19 are here dimensioned such that the bodies 16, 17 are displaceable relative to one another, viewed in the direction of the length extent 8, while the further body is received in the recesses 19.

LIST OF REFERENCE SIGNS

1 Conveyor belt
2 Segment
3 Base
4 Handrail
5 Handrail guide
6 Guide element
7 Border element
8 Longitudinal extent
9 Length compensation element
10 Top side (handrail)
11 Bottom side (handrail)
12 Guide rib
13 Side edge (handrail)
14 Edge (guide rib)
15 V-belt
16 First body
17 Second body
18 Protrusion
19 Slot
20 -
21 Connection means
L Length
$L_{max}$ Maximum length
$L_{min}$ Minimum length
W Width
D Thickness

The invention claimed is:

1. A plate conveyor, comprising:

a conveyor belt formed of interconnected segments that are guided on tracks, said conveyor belt having a longitudinal extent; and a handrail guided on a handrail guide and, at least in portions of said handrail guide, running along said conveyor belt in the direction of the longitudinal extent;

said handrail guide having at least one length compensation element with at least two bodies that are arranged substantially successively in the direction of the longitudinal extent;

said at least two bodies having an adjustable length (L), which, measured in the direction of the longitudinal extent, is adjustable between a maximum length (Lmax) and a minimum length (Lmin);

each of said at least two bodies being formed at one end with plate-like protrusions running in the direction of the longitudinal extent and slot-like recesses in between said protrusions; and wherein at least portions of said protrusions of one of said bodies are received in said recesses of another of said bodies, and vice versa, to render said bodies displaceable relative to one another in the direction of the longitudinal extent.

2. The conveyor device according to claim 1, wherein the length (L) of said length compensation element is steplessly adjustable.

3. The conveyor device according to claim 1, wherein the maximum length (Lmax) amounts to at least 120% of the minimum length (Lmin).

4. The conveyor device according to claim 3, wherein the maximum length (Lmax) amounts to at least 140% of the minimum length (Lmin).

5. The conveyor device according to claim 4, wherein the maximum length (Lmax) amounts to at least 160% of the minimum length (Lmin).

6. The conveyor device according to claim 1, wherein a width (W) of at least one of said recesses is substantially equal to a thickness of a respective protrusion to be received therein.

7. The conveyor device according to claim 6, wherein a width of all of said recesses is substantially equal to a thickness of all of said protrusions to be received therein.

8. The conveyor device according to claim 1, wherein, viewed in the longitudinal extent, said length compensation element has two ends, each with at least one connector for connection of the length compensation element to a guide element of said handrail guide, and/or guide ribs for guiding said handrail.

* * * * *